US010446973B2

(12) United States Patent
Lewin et al.

(10) Patent No.: US 10,446,973 B2
(45) Date of Patent: Oct. 15, 2019

(54) CONDUCTOR ASSEMBLY WITH TWO CONDUCTIVE CORE PARTS

(71) Applicant: Siemens Aktiengesellschaft, Munich (DE)

(72) Inventors: Richard Lewin, Ulverston (GB); Christopher Plant, Lancaster (GB)

(73) Assignee: Siemens Aktiengesellschaft, Munich (DE)

( * ) Notice: Subject to any disclaimer, the term of this patent is extended or adjusted under 35 U.S.C. 154(b) by 137 days.

(21) Appl. No.: 15/556,733

(22) PCT Filed: Mar. 16, 2016

(86) PCT No.: PCT/EP2016/055657
§ 371 (c)(1),
(2) Date: Sep. 8, 2017

(87) PCT Pub. No.: WO2016/146667
PCT Pub. Date: Sep. 22, 2016

(65) Prior Publication Data

US 2019/0115687 A1 Apr. 18, 2019

(30) Foreign Application Priority Data

Mar. 17, 2015 (EP) ..... 15159458

(51) Int. Cl.
*H01R 13/52* (2006.01)
*H01R 13/523* (2006.01)
(Continued)

(52) U.S. Cl.
CPC ..... *H01R 13/523* (2013.01); *H01R 13/15* (2013.01); *H01R 13/521* (2013.01);
(Continued)

(58) Field of Classification Search
CPC ..... H01R 13/2421; H01R 13/2428; H01R 11/284; H01R 13/533; H01R 13/5216; Y10S 439/936
(Continued)

(56) References Cited

U.S. PATENT DOCUMENTS 4,959,022 A * 9/1990 Neuroth ..... E21B 17/028 29/857
2013/0183853 A1* 7/2013 Sivik ..... H02G 3/22 439/519

FOREIGN PATENT DOCUMENTS

GB 1458897 A 12/1976

OTHER PUBLICATIONS

EP Search Report dated Oct. 13, 2015, for EP patent application No. 15159458.7.

(Continued)

*Primary Examiner* — Abdullah A Riyami
*Assistant Examiner* — Justin M Kratt
(74) *Attorney, Agent, or Firm* — Beusse Wolter Sanks & Maire

(57) ABSTRACT

A conductor assembly having first and second conductive core parts, wherein the first conductive core part is axially moveably arranged in respect to the second conductive core part, and having at least one insulating sleeve that is axially moveably arranged in respect to the first and second conductive core parts. At least one loading arrangement is embodied such that the first conductive core part is loaded in an axial direction against the second conductive core part. At least one insulating sleeve having first and second contact surfaces is clamped between the first and second conductive core parts. The clamping force of the loading arrangement is applied by a first corresponding contact surface of the first conductive core part and a second corresponding contact
(Continued)

surface of the second conductive core part to the first and second contact surfaces of the at least one insulating sleeve.

18 Claims, 4 Drawing Sheets

(51) Int. Cl.

| | |
|---|---|
| ***H01R 13/15*** | (2006.01) |
| ***H01R 13/622*** | (2006.01) |
| ***H01R 13/631*** | (2006.01) |
| ***H01R 43/20*** | (2006.01) |
| ***H01R 43/26*** | (2006.01) |
| *H01R 13/533* | (2006.01) |
| *H01R 11/28* | (2006.01) |
| *H01R 13/24* | (2006.01) |

(52) U.S. Cl.
CPC ..... *H01R 13/622* (2013.01); *H01R 13/631* (2013.01); *H01R 43/20* (2013.01); *H01R 43/26* (2013.01); *H01R 11/284* (2013.01); *H01R 13/2421* (2013.01); *H01R 13/2428* (2013.01); *H01R 13/5216* (2013.01); *H01R 13/533* (2013.01); *Y10S 439/936* (2013.01)

(58) Field of Classification Search
USPC ..... 439/700, 482, 824, 519, 276, 936
See application file for complete search history.

(56) References Cited

OTHER PUBLICATIONS

EP Search Report dated Feb. 17, 2016, for EP patent application No. 15159458.7.
International Search Report dated Nov. 18, 2016, for PCT/EP2016/055657.

* cited by examiner

CONDUCTOR ASSEMBLY WITH TWO CONDUCTIVE CORE PARTS

CROSS REFERENCE TO RELATED APPLICATIONS

This application is the US National Stage of International Application No. PCT/EP2016/055657 filed Mar. 16, 2016, and claims the benefit thereof. The International Application claims the benefit of European Application No. EP15159458 filed Mar. 17, 2015. All of the applications are incorporated by reference herein in their entirety.

FIELD OF INVENTION

The present invention relates to a conductor assembly comprising a first conductive core part and at least a second conductive core part, wherein the first conductive core part is axially moveably arranged in respect to the at least second conductive core part, and comprising at least one insulating sleeve that is axially moveably arranged in respect to the first conductive core part and the at least second conductive core part and the invention relates further to a method for operating the aforementioned conductor assembly as well as to two methods for assembling the aforementioned conductor assembly.

ART BACKGROUND

In the near future an increasing demands of communication over wide distances, especially for example between continents will be needed. Hence, infrastructures, like sea cables, connectors and penetrators linking sea cables and modules, e.g. subsea modules, like transformers, pumps etc., that are located and operated error proof subsea will be essential. Some subsea units (pumps, switch gear, VSD, etc.) require electrical connections through a wall to carry high currents at high voltages. These kinds of connectors are often referred to as penetrators. These penetrators must insulate the walls of the module from the high voltage cores of connected cables and be able to withstand these voltages without breakdown or partial discharge. Furthermore, if the unit does not have internal pressure compensation the penetrator will have to withstand high differential pressures. Another issue that penetrators face is that, if they are connected to an external cable, it is possible that a large pulling force may accidentally be applied to the conductive core.

It is for example known to manufacture connectors/penetrators by moulding a plastic insulation layer (normally Epoxy or PEEK) onto a solid copper core. The copper core then provides the conduction path and the plastic insulates the module walls from the high voltages and provides the mechanical strength to withstand the differential pressures. The downsides of this method include that in case of an applied pulling force the moulded connection between the insulation and the conductive component may break. This may cause the connector/penetrator to leak or to expose the high voltage core to fluids which may degrade its performance. With an over-moulded insulation there are other issues like: The plastics have a much greater coefficient of thermal expansion than the copper core. As the copper cores are solid copper this can lead to differential thermal expansion issues. This in turn can lead to high stresses and weakening of the plastic during the curing/heat treatment of the plastic and when the penetrator is exposed to varying temperatures. The moulding method does not lend itself to engineered seals. The sealing between the plastic and the copper core is achieved by bonding the plastic to the metal. However the plastic can be difficult to bond to the metal reliably and the differential thermal expansion issues (mentioned above) can break these bonds, with the same disadvantageous results as stated above. Moreover, the over-moulding process can introduce impurities, weaknesses or air voids in the plastics which can reduce the electrical performance of the connector/penetrator.

It is further known for example from US 2013/0183853 A1 to use a ceramic bushing with a two part copper core with a sliding contact in the middle. The used construction allows an axial movement of the parts of the copper core relative to the ceramic bushing as well as for the longitudinal differential thermal expansion as the length of the copperwork can change without applying extra stress on the bushing. It does however still have disadvantages to do with the sealing method. The seal will be achieved by a metal to metal seal (through welding/brazing etc.) between the conductor and a metallic plating on the ceramic insulator. Not only is this method relatively complicated to reliably achieve a good seal it still relies on metal to insulator bonding for the seal. This will still be vulnerable to differential thermal expansion effects and could be damaged by an accidental pulling force on the parts of the copper core or with thermal cycling. The other disadvantage is that if the seal at the pressurized end does fail/leak for any reason (i.e. through damage due to differential thermal cycling, poor manufacturing, accidental pulling loads or just diffusion though a weakness in the sealing method) it will cause the pressure to build up in the volume between the conductor and insulator. This will load the penetrator in a way that it was not designed for and as the two copper ends are not fixed together, will eject the copper in the non-pressurised end from the penetrator, potentially causing catastrophic failure.

SUMMARY OF THE INVENTION

It is a first objective of the present invention to provide a conductor assembly that provides a secure and reliable sealing between its components and especially in case of an accidentally applied pulling force on its conductive core parts and/or during thermal cycling. Consequently, the conductor assembly may be reliable and less insusceptible to errors, in comparison to state of the art systems.

It is a further objective of the present invention to provide a method for operating such a conductor assembly, wherein a secure and tight connection of parts of the conductor assembly is ensured.

It is still a further object of the invention to provide a method for assembling such a conductor assembly, wherein the method results in a flexible applicability of the conductor assembly.

It is still a further object of the invention to provide a method for assembling such a conductor assembly, wherein the method results in a conductor assembly that can compensate an applied pulling force and a thermal cycling.

These objectives may be solved by a conductor assembly and by methods according to the subject-matter of the independent claims.

According to a first aspect of the present invention, a conductor assembly comprising a first conductive core part and at least a second conductive core part is provided, wherein the first conductive core part is axially moveably arranged in respect to the at least second conductive core part, and wherein the conductor assembly comprises at least one insulating sleeve that is axially moveably arranged in respect to the first conductive core part and the at least second conductive core part.

It is proposed, that the conductor assembly comprises at least one loading arrangement, wherein the at least one loading arrangement is embodied in such a way so that the first conductive core part is loaded in an axial direction against the at least second conductive core part, wherein the at least one insulating sleeve is arranged in respect to the first conductive core part and the at least second conductive core part in such a way so that it is clamped between the first conductive core part and the at least second conductive core part due to the loading between the first conductive core part and the at least second conductive core part applied by the least one loading arrangement and wherein the at least one insulating sleeve comprises a first contact surface and an at least second contact surface, wherein the first conductive core part comprises an first corresponding contact surface to the first contact surface of the at least one insulating sleeve, wherein the at least second conductive core part comprises a second corresponding contact surface to the at least second contact surface of the at least one insulating sleeve and wherein the clamping force of the at least one loading arrangement is applied by the first corresponding contact surface of the first conductive core part and the second corresponding contact surface of the at least second conductive core part to the first and the at least second contact surface of the at least one insulating sleeve.

Due to the inventive matter, interfaces between the insulating sleeve and one or both conductive core parts are in intimate contact with each other during the operation of the conductor assembly or can be brought in contact shortly after a disconnection has occurred due to e.g. a pulling force that was applied to at least one of the conductive core parts. Furthermore, the conductive core parts are retained in place by means of the loading arrangement which acts to pull the conductive core parts against the end faces of the insulating sleeve. Hence, the loading arrangement helps to retain the conductive core parts in the correct position during assembly and operation. In other words, it helps to compensate thermal cycling (expansion or contraction e.g. of the insulating sleeve) as well as to act against accidental movement of the two conductive core parts or compensates the effects of this accidental movement. Moreover, a sealed state of the electrical contact established by the two conductive core parts can be ensured. Furthermore, the overall concept can be easily scalable to be applied to a wide range of product sizes and could be used for any penetrator or bulkhead mounted receptacle pin. A high voltage, high current, high differential pressure conductor assembly (penetrator) that is capable of operating in temperatures of up to 90° C. and that can withstand accidental pulling or seal failure without damage or negative consequences is advantageously provided.

As stated above, the at least one insulating sleeve comprises the first and the at least second contact surface and the first conductive core part comprises the first corresponding contact surface to the first contact surface of the at least one insulating sleeve and the at least second conductive core part comprises the second corresponding contact surface to the at least second contact surface of the at least one insulating sleeve. A good transmission of the clamping force can be provided when the clamping force of the at least one loading arrangement is applied by the first corresponding contact surface of the first conductive core part and the second corresponding contact surface of the at least second conductive core part to the first and the at least second contact surface of the at least one insulating sleeve.

Even if the terms "conductive core part, insulating sleeve, loading arrangement, spring, guidance member, flange, washer, shoulder, contact surface, extension, abutment surface, thread, stud, adapter, pin, locking element and sealing element" (see also below) are used in the singular or in a specific numeral form in the claims and the specification the scope of the patent (application) should not be restricted to the singular or the specific numeral form. It should also lie in the scope of the invention to have more than one or a plurality of the above mentioned structure(s).

A conductor assembly is intended to mean an assembly which has at least a conductor, for example embodied as a conductive core, comprising at least two conductive parts or core parts, connected to one another. Hence, the conductor assembly is an electrical connection assembly. The conductor assembly may be a part of a connector unit, wherein the connector unit physically connects at least two parts, like two cables, advantageously subsea cables, or a cable with a—subsea—module (e.g. a transformer, a pump etc.) or a busbar inside of the module or two modules, respectively. Thus, it is advantageously a subsea connector unit and the conductor assembly a subsea conductor assembly. The conductor assembly or the connector unit, respectively, may be used in any harsh environment and may be embodied as an electrical penetrator or a part of an electrical connector unit or advantageously the electrical penetrator or the electrical connector unit is a wet mateable penetrator/connector unit. Moreover, it is advantageously employed in a high voltage application.

The conductor of the conductor assembly, comprising a first conductive core part and at least a second conductive core part, helps to establish an electrical connection in a mated position of two connected parts, like two cables or a cable with a module. The conductive core part may be a conductor pin, receptacle pin or male part of a penetrator or a socket contact of a female part, plug or connector body of a penetrator for contacting a conductor pin of a male part. Furthermore, the female socket is intended to mean a part of the conductor assembly with an opening, recess or bore to receive another part of the conductor assembly, like the conductor pin or parts thereof. Moreover, the conductor pin may be permanently connected to a cable or a module via a housing. Thus, the conductor pin is intended to mean a part of the unit with a pin, extension or the like to engage or being inserted in the opening of the female socket or the cable or the module. The conductor pin and its corresponding part (female socket, cable or module) are intended to establish an electrical connection via the permanent connection of the conductor pin with the socket, cable or module. The female and male parts or the module each may be encased in a casing or an external of a cable.

Hence, in an embodiment of the invention the conductor assembly is a penetrator assembly. In an alternative embodiment the conductor assembly is a connector pin assembly of a connector part of a (subsea) connector unit.

The wording that "the first conductive core part is axially moveably arranged in respect to the at least second conductive core part" should be understood, that one of the parts may be arranged axially fixed in respect to an external structure and that the other conductive core part is moveable in axial direction relative to the fixed part and the external structure or that both conductive core parts are moveable in axial direction in respect to the external structure.

The insulating sleeve is advantageously a one piece part or in other words, formed integrally. The one piece part is machined out of a solid billet of material (e.g. an extruded bar which is far easier to mould). As a product an integrally formed pre-assembly insulating sleeve is gained. The insulating sleeve may be out of any material suitable for a person skilled in the art that can be machined from a solid form into the integrally formed pre-assembly insulating sleeve. Possible insulation materials are for example glass, machineable ceramic or plastic, like Epoxy or polyaryl ether ketone (PAEK). A advantageous material would be an insulative polyether ether ketone (PEEK). The use of commercially available bar stock for the insulating sleeve will improve the quality of the plastic components and help to prevent partial discharge/electrical weakness caused by inclusions in moulded parts known from prior art systems.

The integrally formed pre-assembly insulating sleeve is advantageously a cylindrical tube, which may have a homogenous, a stepped or a tapered inner and/or outer contour. The specific shape depends on a shape of corresponding structures, like for example the conductive core parts. An inner and/or outer surface of the insulating sleeve may be equipped with a layer or coating, like a bonding layer or a mediator layer having a thermally and/or electrically conductive property. In an embodiment the outer surface and/or the inner surface, and advantageously both, comprises at least one conductive coating to help control the electric field/electrical stresses. The coating may be any coating feasible for a person skilled in the art, like a selected metal layer or a conductive plastic layer. Thus, the material may for example be copper, a copper alloy, aluminium, a nickel-cobalt ferrous alloy (e.g. Kovar®), molybdenum, titanium, (phosphorous) nickel, a polymer material, like engineering plastic or a material out of the PAEK family or Epoxy family or polyamide family, advantageously, polyether ether ketone (PEEK), or a thermoset polymer material, like an epoxy material.

For the equipping with the coating any method feasible for a person skilled in the art could be used, like plating, spraying, vapour deposition, sputtering etc. The wording that the insulating sleeve is "axially moveably arranged" in respect to the two conductive core parts should be understood in that the insulating sleeve is not bonded or connected to the conductive core parts in any other way than by the clamping applied by the loading arrangement (see below). The insulating sleeve is arranged in circumferential direction around a section of both conductive core parts.

In this context a "loading arrangement" is intended to mean an arrangement that is able to apply a loading force, especially, in a selected orientation—here in axial direction—on a functionally related or spatially arranged part, in this case on the first conductive core part, especially, in respect to a further part here the at least second conductive core part. Moreover, the wording "is loaded in an axial direction" should be understood in that a direction of the loading force of the loading arrangement is oriented axially or in parallel to an axis of the conductor assembly. The term "loaded" should also be understood as "pulled due to a directed loading force". Further, the wording "clamped between . . . due to the loading . . . applied by the least one loading arrangement" should be understood as to be held in position between the two conductive core parts due to a loading force acting on the two conductive core parts. That there might be conditions in which the clamping of the insulating sleeve between the conductive core parts might be temporary released, e.g. in case of an applied pulling force on at least one of the conductive core parts, should not hinder the feature of the clamping of the insulating sleeve.

It is further provided, that the first conductive core part is embodied as a pin and the at least second conductive core part is embodied as a bushing, wherein the pin is arranged slideably in the bushing. Thus, the issues of differential thermal expansion along the length of the bushing are removed. Radially between an outer surface of the pin and an inner surface of the bushing at least an electrical contact, advantageously embodied as so called multilam, is provided. Thus, the electrical contact can be maintained over a suitable axial length. The bushing may be embodied as any structure feasible for a person skilled in the art, like a jacket or it is advantageously embodied as a cap.

In an embodiment of the invention the at least one loading arrangement is arranged axially between an axial end of the first conductive core part the pin—and an axial stop of an axial end of the at least second conductive core part the bushing. In other words, the at least one loading arrangement is positioned in an aperture of the bushing or a blind hole of the cup. Hence, a space saving and loss-proof arrangement can be provided. The axial stop may be formed integrally with the bushing, like being embodied as a bottom of the cap, or it may be embodied as a separate piece that is fastened to the bushing.

In a further realisation of the invention the at least one loading arrangement comprises at least one preloadable spring and at least one guidance member for the at least one preloadable spring. Thus, a movement of the spring can be supported. The term "preloadable" should be understood as the ability to undergo an elastic deformation and thus to store energy due to the elastic deformation. The stored energy is a reset force. Advantageously, the spring is assembled in the conductor assembly in a final assembled state of the conductor assembly in a preloaded state so that it applies the loading force on the conductive core parts or to pull the conductive core parts against end surfaces of the insulating sleeve.

The preloadable spring is axially clamped and/or constricted by a radial flange of the at least one guidance member and a washer mounted axially slideable on the at least one guidance member. Hence, two structures can be provided that can act on the spring and can adjust the loading force mediated or triggered by different sources. Advantageously, the washer axially abuts a radial shoulder of an axial jacket-like extension fixed to the first conductive core part (details see below). Hence, movements acting on the first conductive core part can be mediated directly to the spring.

In general, the spring pulls the conductive core parts against the end faces of the insulating sleeve and thus retains the conductive core parts and the insulating sleeve in a specific and wanted spatial arrangement. Hence, the pin and the bushing are pulled axially towards each other by the spring mechanism of the loading arrangement and by this action the insulating sleeve is clamped between the two conductive core parts. Furthermore, the spring helps to act against accidental movement of the two conductive core parts.

A blockage-free interaction of the contact surfaces that can be, when needed, repeated several times is provided when the first contact surface and the at least second contact surface of the at least insulating sleeve and the first corresponding contact surface of the first conductive core part and the second contact surface of the second conductive core part are arranged basically perpendicular and advantageously perpendicular to an axis of the conductor assembly. Thus, all contact surfaces are radial abutment surfaces.

Furthermore, it is provided that the at least second conductive core part comprises a stud-like extension and the first conductive core part comprises a jacket-like extension encompassing the stud-like extension. By means of this suitable structures for an adjustable connection and interaction of the first and the at least second conductive core parts may be realised.

The jacket-like extension and the stud-like extension are advantageously embodied as a stabilising or security element to provide a mechanical stop in cased of a relative movement of the first conductive core part and the at least second conductive core part in respect towards each other. To restrict a movement of the stud-like extension and the jacket-like extension towards each other the stud-like extension and the jacket-like extension each comprises at least one abutment surface facing towards each other. The abutment surfaces work together as a mechanical stop. Hence, a compression of the at least one preloadable spring is stopped when the abutment surfaces of the stud-like extension and the jacket-like extension contact each other. Hence, the axial movement of the two conductive core parts towards each other is restricted by the abutment surfaces before the spring might break. Thus, the abutment surfaces prevent the spring to be compressed to a detrimental degree.

It is further provided, that the stud-like extension and the jacket-like extension are embodied out of a high strength material and especially, out of a material selected out of the group consisting of: stainless steel, titanium and a high strength metallic allow such as MP35N. With these materials the extensions or parts thereof can be withstand high forces, wherein the conductor assembly can be embodied secure and reliable. Advantageously, the material is titanium. Hence, the extensions and the conductor assembly are advantageously embodied with a light weight.

The spring is arranged radially in the jacket-like extension. Thus, there is an assembly of titanium (or other high strength material) components arranged around the spring. The purpose of these is to act as a fixed mechanical stop if the conductive core parts move against the spring due to accidental pulling forces or due to leaking seals. This will stop the conductive core parts from moving too far and is toleranced such that neither the electrical contact nor any of the elastomeric seals (see below) can be broken by the movement alone. The titanium components are designed to be strong enough that even if all and in this exemplary case both of the seals at the pressurized end were to fail at the maximum differential pressure the fixed mechanical stop will not break. Therefore, even a double seal failure, cannot cause either electrical or mechanical catastrophic failure of the conductor assembly. Moreover, the high strength fixed mechanical stop will prevent the spring from being fully compressed which may damage or break the retaining spring. The extensions and especially the jacket-like extension or the high strength fixed mechanical stop is strong enough that the conductor assembly cannot undergo electrical or mechanical catastrophic failure due to multiple seal failure or due to accidental pulling forces.

As stated above, the at least one loading arrangement comprises at least one guidance member and at least one preloadable spring, wherein the preloadable spring is mounted on the at least one guidance member. In an embodiment the invention the at least one guidance member is arranged axially moveable in respect to the first conductive core part or its jacket-like extension, respectively. Thus, the preloadable spring can be compressed constructively easy due to the interaction of the washer with the shoulder of the jacket-like extension and by a relative movement of the guidance member in respect to the first conductive core part e.g. in case of an applied pulling force at the at least second conductive core part.

To trigger the movement of the at least one guidance member reliably with the at least second conductive core part the at least one guidance member is arranged axially fixed in respect to the at least second conductive core part.

According to an embodiment of the invention the first conductive core part or its axial end, respectively, comprises an external thread and the jacket-like extension a corresponding internal thread at its axial end facing the first conductive core part for screwing the jacket-like extension to the first conductive core part. Thus, a secure and reliable fastening can be provided.

A likewise stable connection of the at least second conductive core part and the stud-like extension can be provided, when they are also fastened by at least one threaded connection. Thus, the at least second conductive core part comprises an internal thread. Taking into account an assembly sequence of the conductor assembly the stud-like extension needs at least two subsequently assembled pieces with threaded connections. Consequently, the stud-like extension comprises at least a stud and thread adapter. The thread adapter comprises an external tread for screwing the thread adapter in the at least second conductive core part. To screw the stud in the thread adapter the stud comprises an external thread and the thread adapter a corresponding internal thread.

During assembly of the conductor assembly or the preload arrangement in the former the jacket-like extension is slidably connected to the stud-like extension, which, in turn, is screwed into the at least second conductive core part. To fasten the resulting assembly unit to the first conductive core part the assembly unit is screwed together by the interaction of the external tread of the first conductive core part with the internal thread of the jacket-like extension. Here it is essential that the jacket-like extension circumferentially moves with the stud like extension and the at least second conductive core part, respectively. Hence, the conductor assembly comprises at least one locking pin positioned between the jacket-like extension and the stud-like extension to provide a circumferential locking of the jacket-like extension to the at least second conductive core part. Thus, the assembling can be performed constructively easy and reliable. The locking pin is advantageously a dowel pin that is known in the art to facilitate reliable locking actions so that the jacket-like extension is positioned in a position secure fashion with the at least second conductive core part.

As stated above, the stud-like extension comprises at least the stud and it further comprises a locking element threaded into the stud. Hence, other parts of the loading arrangement can be easily connected with the stud and consequently with the stud-like extension and the at least second conductive core part. Advantageously, the locking element axially connects the at least one guidance member to the stud-like extension. This provides a loss-proof connection of the at least second conductive core part and the at least one guidance member. To connection the at least one locking element with the at least one guidance member the latter comprises an aperture, wherein the at least one locking extends through the aperture and wherein an interaction of a head of the at least one locking element with an internal surface of the at least one guidance member axially locks the at least one guidance member to the screw. The at least on locking element may be screwed into the aperture or just be inserted. There is no need of a circumferential locking between the at least one guidance member and the locking element.

In a further realisation of the invention the conductor assembly comprises at least one sealing element arranged radially between the at least one insulating sleeve and the first conductive core part and/or the at least second conductive core part. Thus, the conductor assembly can be effectively protected e.g. from ingress of water etc. The sealing element is advantageously made by elastomeric seals tolerant to the differential thermal expansion between the two components the insulating sleeve and either the first or the at least second conductive core part. Thus, the sealing is easy to create repeatedly and engineered elastomeric seals are very tolerant to the differential thermal expansion so thermal cycling cannot damage the seals.

The invention further relates to a method for operating such an inventive conductor assembly. It is provided that the method comprises at least the steps of: Connecting a first conductive core part a pin—and an at least second conductive core part a cap—in a loaded position in an axial direction by at least one loading arrangement, wherein the first conductive core part is pulled due to a directed loading force in the axial direction against the at least second conductive core part, clamping the at least one insulating sleeve between the first conductive core part and the at least second conductive core part due to the loading between the first conductive core part and the at least second conductive core part applied by the least one loading arrangement and establishing an electrical link between the first conductive core part and the at least second conductive core part.

Due to the inventive matter, a secure and tight connection of the conductive core parts and the insulating sleeve can be ensured. Moreover, even in the case that seals of the conductor assembly fail a reliable operation of the conductor assembly is provided.

The invention further relates to a method for assembling an inventive conductor assembly. It is provided that the method comprises at least the steps of: Preloading at least one spring of a loading arrangement due to the clamping of at least one insulating sleeve between a first conductive core part and an at least second conductive core part, wherein the clamping force of the at least one loading arrangement is applied by a first corresponding contact surface of the first conductive core part and a second corresponding contact surface of the at least second conductive core part to a first and an at least second corresponding contact surface of the at least one insulating sleeve and especially holding a loading force of the spring in the assembled state of the conductor assembly so that the spring has a spring force that has a preload between 10% and 90%, advantageously, of about 60%.

Due to the inventive matter the conductor assembly can be embodied flexible and it can react to different situations adequately. Moreover, the loading arrangement has a self-acting mechanism.

The requirements for the preload are that there will always be some preload; even at low temperatures but that the preload is not too high (>90%) that the spring would be fully compressed at high temperatures. Nominally the initial preload is about 60%. Thus, the preloadable spring of the loading arrangement is held in its neutral position in a preloadable state of about 60% preload by the first conductive core part and the at least second conductive core part.

The invention further relates to a further method for assembling a conductor assembly. It is proposed that the method comprises at least the following steps in an arbitrary sequence: Machining at least one insulating sleeve out of a block of solid material, finishing the at least one insulating sleeve, wherein both possible sequences result in an integrally formed pre-assembly insulating sleeve and wherein the method further comprises the step of: Assembling the obtained integrally formed pre-assembly insulating sleeve in the conductor assembly by clamping the least one insulating sleeve between a first conductive core part of the conductor assembly and an at least second conductive core part of the conductor assembly due to the loading between the first conductive core part and the at least second conductive core part applied by at least one loading arrangement and wherein the first conductive core part is pulled due to a directed loading force of the least one loading arrangement in an axial direction against the at least second conductive core part.

Due to the inventive matter, a conductor assembly can be gained that can compensate an applied pulling force and a thermal cycling. Moreover, by the use of an integrally formed pre-assembly insulating sleeve or such a pre-manufactured insulating sleeve an interface between the insulating sleeve and the conductive core part is free of air entrapment or contamination or void free or air tight, which could have lower breakdown strength than the insulation. Hence, a risk for partial discharge is minimised providing a reliable conductor assembly. Furthermore, by using the inventive method, the insulation of the conductor assembly may be placed under greater electrical stress in comparison with state of the art systems. Hence, a system with fewer electrical issues, compared with state of the art systems, may advantageously be provided.

The above-described characteristics, features and advantages of this invention and the manner in which they are achieved are clear and clearly understood in connection with the following description of exemplary embodiments which are explained in connection with the drawings.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
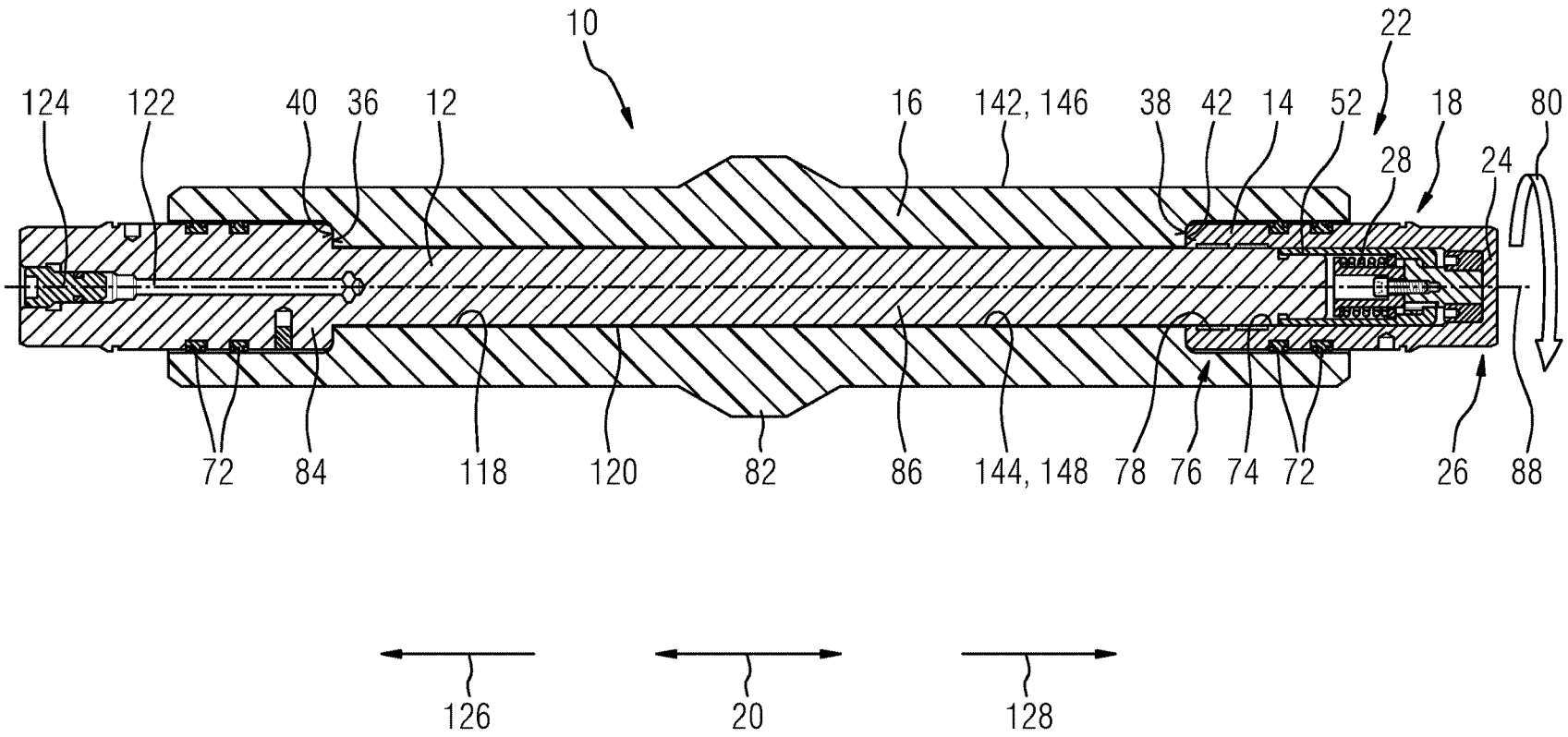
FIG. 1: shows schematically an inventive subsea conductor assembly with two conductive core parts and an insulating sleeve.

The illustrations in the drawings are schematically. It is noted that in different figures, similar or identical elements are provided with the same reference signs.

FIG. 1 shows an inventive high voltage subsea conductor assembly 10 for connecting for example a subsea cable and a module (not shown). Thus, the conductor assembly 10 is a subsea penetrator. The conductor assembly 10 comprises a first conductive core part 12 or conductor pin 12 and a second conductive core part 14 or a bushing 14 or cap 14, respectively. Both conductive core parts 12, 14 are out of copper. Further, both conductive core parts 12, 14 may be encased in a housing (not shown). The first conductive core part 12 is for example connected to the cable and the second conductive core part 14 is arranged in a housing of the module (not shown).

The second conductive core part 14 comprises an axially extending bore 74. The first conductive core part 12 extends into the bore 74 and is arranged axially moveable and specifically slideably in the bushing 14. In a front region 76 the bore 74 of the second conductive core part 14 an electrical interface 78 with in this exemplary embodiment two multilams is provided to establish an electrical link between the two conductive core parts 12, 14.

Moreover, the conductor assembly comprises an insulating sleeve 16 out of, for example, insulative polyether ether ketone (PEEK). Generally, a different PAEK or glass filled PEEK, or a glass or ceramic may be used. The insulating sleeve 16 is arranged in circumferential direction 80 partly around the conductive core parts 12, 14. The insulating sleeve 16 is a one piece part or, in other words, an integrally formed pre-assembly insulating sleeve 16 pre-manufactured in such a case to fit the contours and dimensions of the conductive core parts 12, 14.

Moreover, the insulating sleeve 16 comprises an outer surface 142 and an inner surface 144. Both these surfaces 142, 144 comprise a conductive coating 146, 148. The conductive coating 148 is radially arranged between the conductive core parts 12, 14 and the insulating sleeve 16 (The coatings 146, 148 are not shown in detail).

Furthermore, the insulating sleeve 16 comprises a radially broadened segment 82 to provide a locking structure for the locking of the penetrator in the module. Further, the insulating sleeve 16 is axially moveably arranged in respect to the first conductive core part 12 and the second conductive core part 14. Thus, there may be conditions where the insulating sleeve moves relative to the conductive core parts 12, 14.

To preventing entering of dirt into internals of the electrical contact area the conductor assembly comprises several sealing elements 72 embodied as elastic ring seals. In each case, two axially adjacently arranged sealing elements 72 are positioned radially between the insulating sleeve 16 and a radially enlarged section 84 of the first core part 12 or the second conductive core part 14. Since the radially enlarged section 84 and the cap 14 have the same axial length and the same diameter the insulating sleeve 16 can be manufactured symmetrically.

Due to the enlarged diameters of the enlarged section 84 and the second conductive core part/cap 14 in respect to a diameter of a pin-shaped section 86 of the first conductive core part 12 the insulating sleeve 16 comprises a first contact surface 36 and a second contact surface 38 and the first conductive core part 12 comprises an first corresponding contact surface 40 to the first contact surface 36 and the second conductive core part 14 a second corresponding contact surface 42 to the second contact surface 38. All contact surfaces 36, 38, 40, 42 are oriented perpendicular to an axis 88 of the conductor assembly 10.

To ensure that a tight connection between the respective contact surfaces 36, 38, 40, 42 is established and maintained during an operation of the conductor assembly 10 the conductor assembly 10 comprises a loading arrangement 18, that is embodied in such a way so that the first conductive core part 12 is loaded in an axial direction 20 against the second conductive core part 14 and that the insulating sleeve 16 is arranged in respect to the two conductive core parts 12, 14 in such a way so that it is clamped between the two conductive core parts 12, 14 due to the loading between the two conductive core parts 12, 14 applied by the loading arrangement 18. And specifically, the clamping force of the at loading arrangement 18 is applied by the first corresponding contact surface 40 of the first conductive core part 12 and the second corresponding contact surface 42 of the at least second conductive core part 14 to the first and the second contact surfaces 36, 38 of the insulating sleeve 16.

Figure 3:
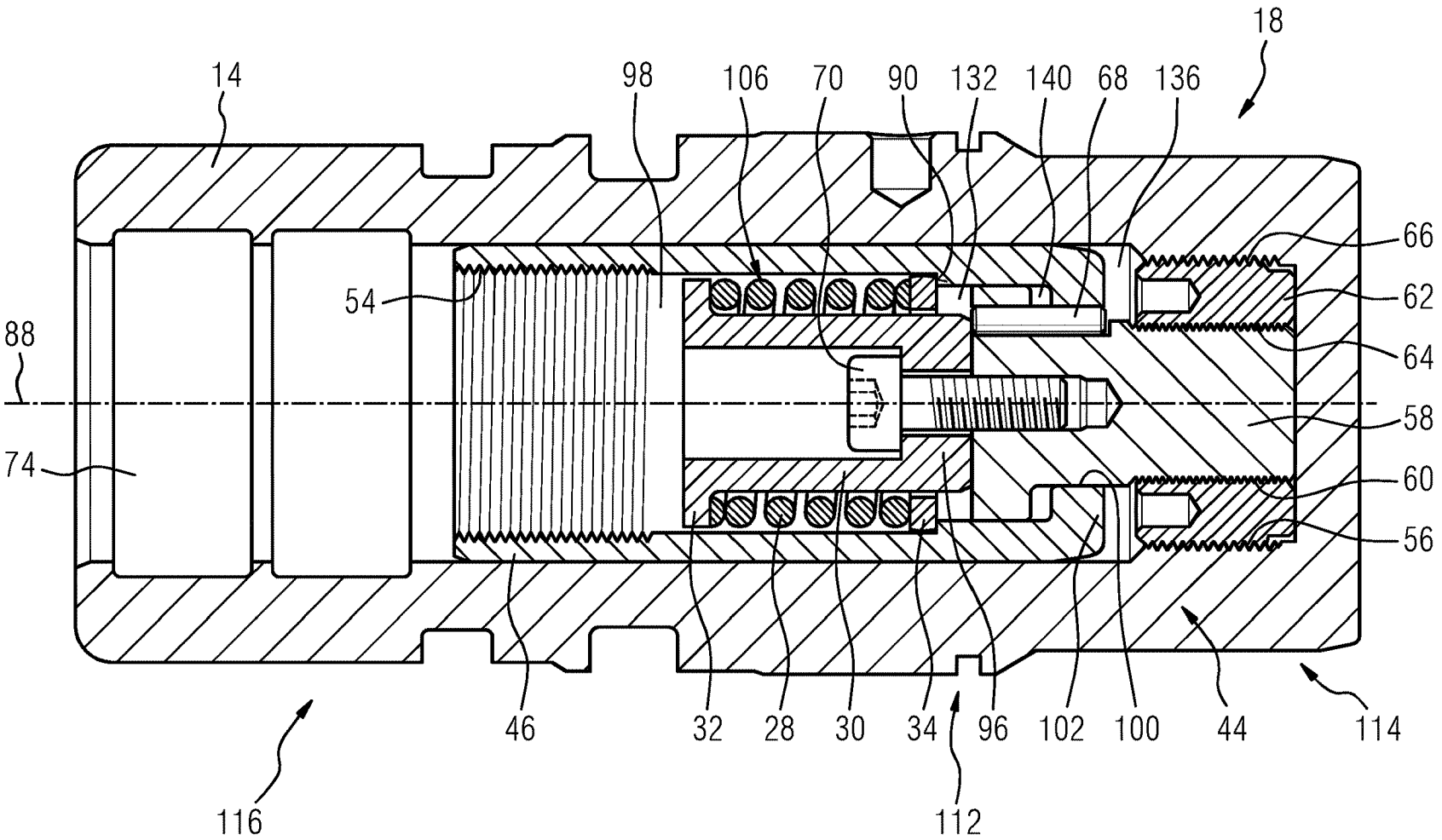
FIG. 3: shows schematically the assembled preload arrangement from FIG. 2 arranged in a conductive core part from FIG. 1 after a second assembly sequence

The loading arrangement 18 is arranged in the bore 74 of the cap 14 axially between an axial end 22 of the first conductive core part 12 and an axial stop 24 of an axial end 26 of the second conductive core part 14 (see also FIG. 3). The loading arrangement 18 comprises a preloadable spring 28, a guiding member 30, a washer 32, a jacket-like extension 46 with a shoulder 90, a stud-like extension 44 with a stud 58 and a thread adapter 62, a locking pin 68 and a locking element 70.

The guidance member 30 is a cylindrical bushing comprising a radial flange 32 and a central bore 92 narrowing in a through hole 94 in a bottom 96 of the guidance member 30. Moreover, the jacket-like extension 46 is a cylindrical bushing comprising a central bore 98 narrowing in a through hole 100 in a bottom 102 of the jacket-like extension 46.

Figure 2:
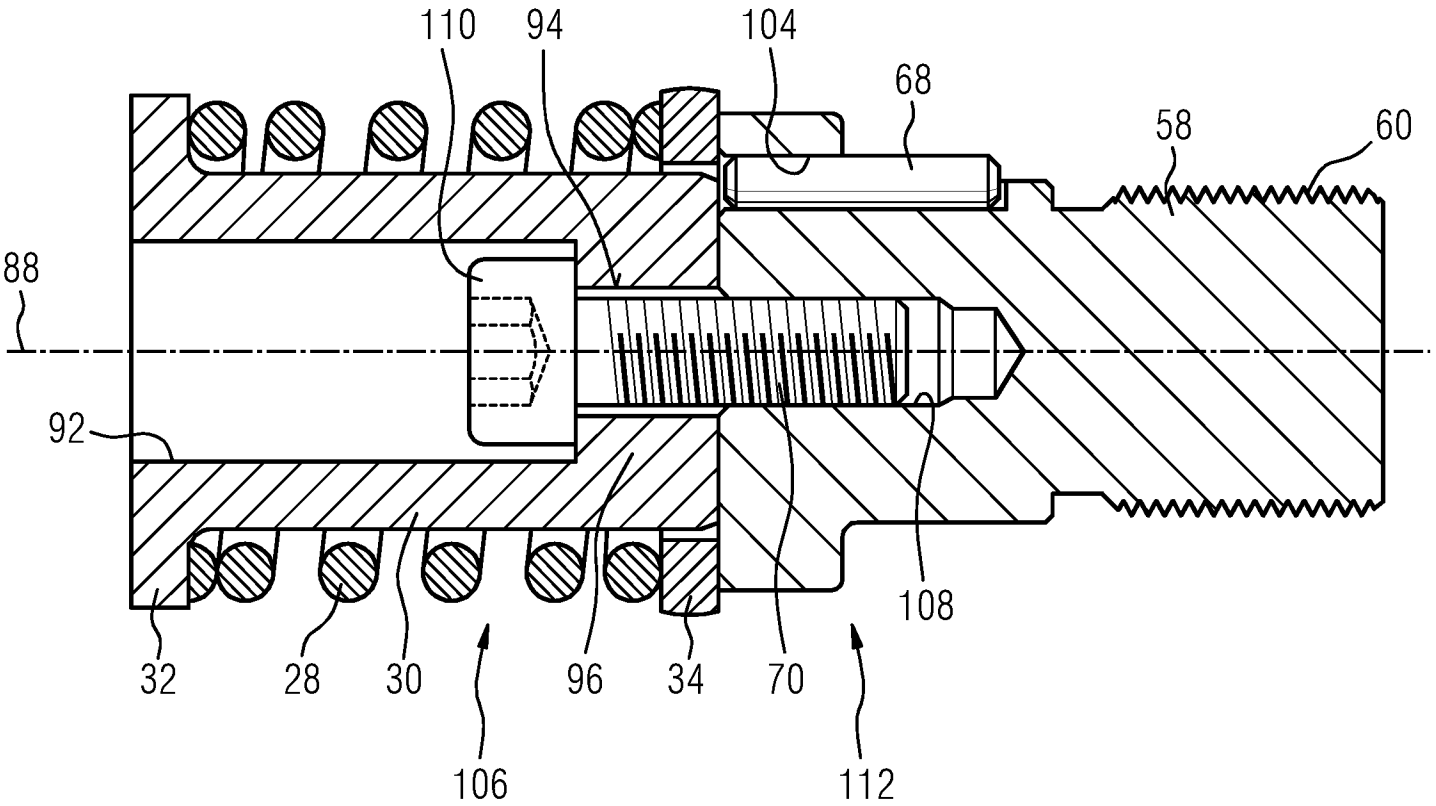
FIG. 2: shows schematically pieces of a preload arrangement of the conductor assembly from FIG. 1 after a first assembly sequence.
Figure 4:
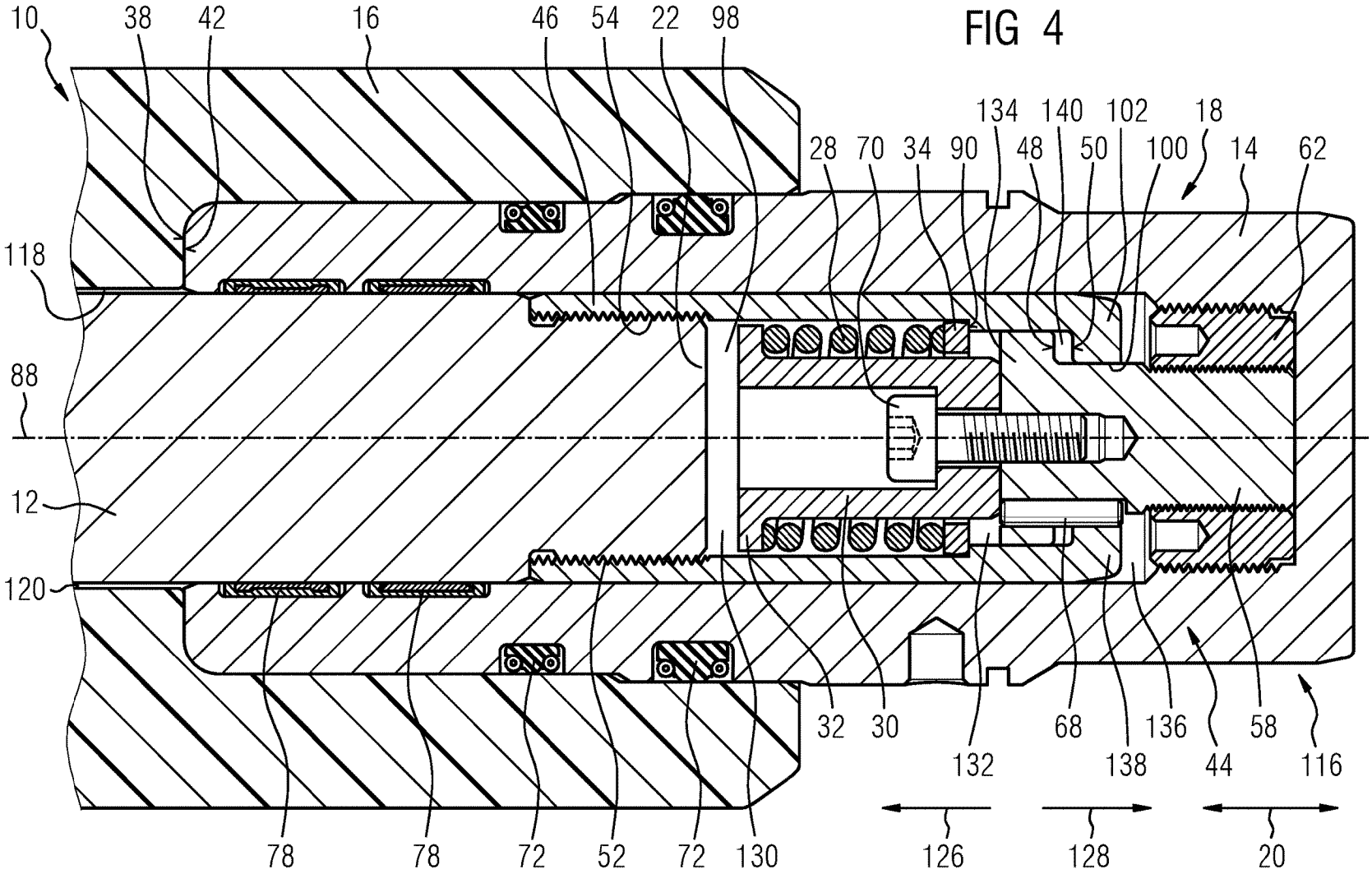
FIG. 4: shows the preload arrangement from FIG. 3 and the two conductive core parts from FIG. 1 in the fully assembled state.

For a better understanding of the mechanics of the loading arrangement 18 an assembly sequence of the conductor assembly 10 and specifically the preload arrangement 18 is explained on the basis of FIGS. 2 to 4, which show assembly stages as well as the fully assembled conductor assembly 10.

The locking pin 68, embodied as a dowel pin, is inserted in an aperture 104 of the stud 58. The preloadable spring 28 and the washer 34 are mounted on the guidance member 30 so that the preloadable spring 28 is axially clamped by the radial flange 32 of the guidance member 30 and the washer 34 mounted axially slideable on the guidance member 30 building a spring assembly 106. Subsequently, the spring assembly 106 is secured to the stud 58 by inserting the locking element 70, embodied as a bolt, through the through hole 94 in the bottom 96 of the guidance member 30 and screwing it into a bore 108 of the stud 58. The connection is axially fixed by an abutment of a head 110 of the locking element 70 with the bottom 96 of the guidance member 30 and results in a spring-stud assembly 112 (see FIG. 2). Hence, the locking element 70 axially connects the guidance member 30 and thus the spring 28 to the stud-like extension 44.

In the next step the jacket-like extension 46, which also acts as an outer spring stop, is placed over the spring-stud assembly 112 so that the stud 58 extends through the through hole 100 in the bottom 102 and the shoulder 90 abuts the washer 34 (see FIG. 3). The stud 58 is slideably arranged in the jacket-like extension 46 or it's through hole 100, respectively. Subsequently, the stud 58 is screwed with its external thread 60 in the corresponding internal thread 64 of the thread adapter 62 and the resulting adapter assembly 114 is screwed with an external tread 66 of the thread adapter 62 in an internal thread 56 of the second conductive core part 14 to form a cap assembly 116.

In the next step the electrical interface 78, the multilams, are positioned into the bore 74 of the cap assembly 116 and sealing elements 72 are positioned at the cap 14 as well as at the enlarged section 84 of the pin 12 (see FIG. 1). Subsequently, the pin 12 is positioned in the insulating sleeve 16 by inserting it through an aperture 118 of the insulating sleeve 16. Further, a radial gap 120 between the pin 12 and the insulating sleeve 16 is filled with a suitable filler (i.e. a soft rubber, grease or an adhesive e.g. Sylgard 170) to provide good thermal contact between the copper core and the insulating sleeve 16. After the fill the used insertion hole 122 in the enlarged section 84 of the pin 12 is sealed with a seal bung 124.

By rotating the cap assembly 116 it is screwed with an internal thread 54 of the bore 98 of the jacket-like extension 46 to an external thread 52 of the pin 12 (see also FIG. 4). During the screwing the locking pin 68 positioned between the jacket-like extension 46 and the stud-like extension 44 provides a circumferential locking of the jacket-like extension 46 in respect to the second conductive core part 14. In other words, the locking element 70 prevents a rotation between the jacket-like extension 46 and the rest of the cap assembly 116. This allows the threads 52, 54 to be tightened by rotating the two conductive core parts 12, 14 within the insulating sleeve 16. The conductor assembly 10 is now completely assembled as it is shown in FIG. 1.

By this assembling sequence the spring 28 of a loading arrangement 18 is preloaded due to the clamping of the insulating sleeve 16 between the two conductive core parts 12, 14. Especially, the dimensions of the pieces and the properties of the spring 28 are selected in such a way that in the assembled state of the conductor assembly 10 a loading force of the spring 28 is held so that the spring 28 has a spring force that has a preload of about 60%.

Beforehand of assembly the insulating sleeve 16 is prepared or manufactured, respectively. Therefore, the insulating sleeve 16 is machined out of a block of solid material and finished to obtain an integrally formed pre-assembly insulating sleeve 16. In the finishing step the coatings 146, 148 are for example applied. This obtained integrally formed pre-assembly insulating sleeve 16 is than assembled in the conductor assembly 10.

The loading arrangement 18 ensures that in case of external influences that may affect e.g. a spatial arrangement of pieces of the conductor assembly 10 or the material properties of pieces of the conductor assembly 10 the contact between the insulating sleeve 16 and the two conductive core parts 12, 14 remains. The loading arrangement 18 is toleranced such that the contact surfaces 36, 38, 40, 42 cannot be disconnected once assembled. The external influence can for example be a temperature change causing a different thermal reaction of the insulating sleeve 16 or the two conductive core parts 12, 14 or an applied so called snag-load acting on at least one of the conductive core parts 12, 14.

In the following passages these different scenarios will be described on the basis of FIGS. 1 and 4.

The plastics used for the insulating sleeve 16 have a much greater coefficient of thermal expansion than the copper of the conductive core parts 12, 14. So if a temperature in the operating environment drops, the insulating sleeve 16 contracts or shrinks to a higher extent than the conductive core parts 12, 14. Thus, without the loading arrangement 18 a gap would occur between the contact surfaces 36, 38, 40, 42 of the insulating sleeve 16 and the two conductive core parts 12, 14 (not shown). This is prevented by the loading arrangement 18.

When the insulating sleeve 16 contracts the cap 14 and the radially enlarged section 84 of the pin 12 are no longer axially held in a fixed position by the contact surfaces 36, 38 of the insulating sleeve 16. Thus, the cap 14 and the pin 12 move or are pulled axially towards each other due to the action of the spring 28. Specifically, the preloaded spring 28 expands and pushes the guidance member 30 via its flange 32 in direction 126 towards the pin 12. Because the guidance member 30 is arranged axially moveable in respect to the first conductive core part 12 and is axially fixed in respect to the conductive core part 14 the conductive core part 14 or cap 14 is pulled in direction 126 towards the pin 12 via a connection axis comprising the locking element 70, the stud 58 and the thread adapter 62.

At the same time, the spring 28 pushes the washer 34 in a direction 128 contrariwise to the direction 126 and consequently the pin 12 is pulled via a connection axis comprising the washer 34, the shoulder 90 and the jacket-like extension 46 in direction 128 towards the cap 14. During this action an axial space 130 between the axial end 22 of the pin 12 and the flange 32, an axial space 132 between the washer 34 and a head 134 of the stud 58 and an axial space 136 between an axial end 138 of the jacket-like extension 46 and the thread adapter 62 is reduced. These spaces 130, 132, 136 are selected during the assembly process in their dimension so that a maximal expected shrinking of the insulating sleeve 16 is taken into account (not shown).

In case the temperature in the operating environment increases the insulating sleeve 16 expands to a higher extent than the conductive core parts 12, 14. Hence, without the loading arrangement 18 the expansion of the insulating sleeve 16 may cause stresses on the conductive core parts 12, 14 or it might be damaged itself. This is prevented by the loading arrangement 18.

When the insulating sleeve 16 expands the contact surfaces 36, 38 push due to the contact with the corresponding contact surfaces 40, 42 the pin 12 in direction 126 and the cap 14 in direction 128. In other words, the two conductive core parts 12, 14 are pushed away from each other. Due to these movements the spring 28 is compressed. Specifically, the pin 12 pulls the jacket-like extension 46 in direction 126 and this movement is transferred to the spring 28 via the connection axis comprising the shoulder 90 and the washer 34. At the same time the cap 14 pulls the guidance member 30 in direction 128 via the connection axis comprising the locking element 70, the stud 58 and the thread adapter 62.

During this action an axial gap 140 between the head 134 of the stud 58 and the bottom 102 of the jacket-like extension 46 is reduced (not shown). To restrict this axial movement and to provide a security feature that prevents that the spring 28 is compressed to such an extent that it might be damaged the stud-like extension 44 or the head 134 of the stud 58, respectively, and the jacket-like extension 46 comprise an abutment surface 48, 50 that face towards each other.

To further provide a secure construction that might resist even high forces, like high pulling forces (details see below) the stud-like extension 44 or its stud 58 and the thread adapter 62, respectively, and the jacket-like extension 46 are manufactured out of a high strength material and specifically, out of titanium. Thus, these parts are titanium retention components. A dimension of the gap 140 is selected during the assembly process in respect of the properties of the spring 28 or the adjusted preload of the spring 28.

This security features have an even higher relevance in case a pulling force or a snag-load acts on one or both of the conductive core parts 12, 14. When pulled at one of the core parts 12, 14 either in direction 126 (pin 12) or direction 128 (cap 14) the spring 28 is compressed according to the same mechanics as described above in case of the expansion of the insulating sleeve 16. An axial gap might be built between the contact surfaces 36, 38, 40, 42 of the insulating sleeve 16 and the two conductive core parts 12, 14 (not shown).

During the pulling action the preload arrangement 18 holds the conductor assembly 10 in its intended operational state or it can prevent gaps between the contact surfaces 36, 38, 40, 42 due to its self-acting mechanism. Specifically, the now even further compresses spring 28 expands and pushes the guidance member 30 via its flange 32 in direction 126 towards the pin 12. Consequently, the cap 14 is pulled in direction 126 towards the pin 12 via a connection axis comprising the locking element 70, the stud 58 and the thread adapter 62. Moreover, the spring 28 pushes the washer 34 in direction 128 and consequently the pin 12 is pulled via the connection axis comprising the washer 34, the shoulder 90 and the jacket-like extension 46 in direction 128 towards the cap 14. Hence, the forming of gaps between the contact surfaces 36, 38, 40, 42 is prevented and the gap 140 is re-established.

Thus, a method for operating the conductor assembly 10 comprises the steps of: Connecting the first conductive core part 12 and the second conductive core part 14 in a loaded position by the loading arrangement 18 and thereby establishing a reliable electrical link between the first conductive part 12 and the second conductive core part 14.

Hence, with such constructed loading arrangement 18 and consequently conductor assembly 10 a reliable and secure operation can be provided. This is still the case even if all and in this exemplary embodiment both of the sealing elements 72 at the pressurized end were to fail at the maximum differential pressure. Therefore, even a double seal failure, cannot cause either electrical or mechanical catastrophic failure of the conductor assembly 10. Moreover, the high strength fixed mechanical stop will prevent the spring 28 from being fully compressed which may damage or break the retaining spring 28.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

Although the invention is illustrated and described in detail by the preferred embodiments, the invention is not limited by the examples disclosed, and other variations can be derived therefrom by a person skilled in the art without departing from the scope of the invention.

The invention claimed is:

1. A conductor assembly comprising:

a first conductive core part and at least one second conductive core part, wherein the first conductive core part is axially moveably arranged with respect to the at least one second conductive core part, and comprising at least one insulating sleeve that is axially moveably arranged with respect to the first conductive core part and the at least one second conductive core part, and at least one loading arrangement comprising a resilient element, wherein the at least one loading arrangement is embodied such that the first conductive core part is loaded in an axial direction toward the at least one second conductive core part by a resilience of the resilient element that acts in the axial direction, wherein the at least one insulating sleeve is arranged with respect to the first conductive core part and the at least one second conductive core part such that the at least one insulating sleeve is clamped between a first contact surface of the first conductive core part and a second contact surface of the at least one second conductive core part due to the loading that loads the first conductive core part toward the at least one second conductive core part, and wherein the at least one insulating sleeve comprises a first contact surface and at least one second contact surface, wherein the first contact surface of the first conductive core part corresponds to the first contact surface of the at least one insulating sleeve, wherein the second contact surface of the at least one second conductive core part corresponds to the at least one second contact surface of the at least one insulating sleeve, and wherein a clamping force of the at least one loading arrangement is applied by the first contact surface of the first conductive core part and the second contact surface of the at least one second conductive core part to the first and the at least one second contact surface of the at least one insulating sleeve.

2. The conductor assembly according to claim 1, wherein the first conductive core part is embodied as a pin, wherein the at least one second conductive core part is embodied as a bushing, and wherein the pin is arranged slideably in the bushing.

3. The conductor assembly according to claim 1, wherein the at least one loading arrangement is arranged axially between an axial end of the first conductive core part and an axial stop of an axial end of the at least one second conductive core part.

4. The conductor assembly according claim 1, wherein the resilient element comprises at least one preloadable spring and at least one guidance member for the at least one preloadable spring, wherein the at least one preloadable spring is axially clamped by a radial flange of the at least one guidance member and a washer mounted axially slideable on the at least one guidance member.

5. The conductor assembly according to claim 1, wherein the at least one second conductive core part comprises a stud-like extension, wherein the first conductive core part comprises a jacket-like extension encompassing the stud-like extension, and wherein the stud-like extension and the jacket-like extension each comprises at least one abutment surface facing towards each other.

6. The conductor assembly according to claim 5, wherein the stud-like extension and the jacket-like extension are embodied out of a material selected out of the group consisting of: titanium, stainless steel, a high strength metallic alloy, MP35N.

7. The conductor assembly according to claim 1, wherein the at least one loading arrangement comprises at least one guidance member and the resilient element comprises at least one preloadable spring, wherein the at least one preloadable spring is mounted on the at least one guidance member, and wherein the at least one guidance member is arranged axially moveable with respect to the first conductive core part, and wherein the at least one guidance member is arranged axially fixed with respect to the at least one second conductive core part.

8. The conductor assembly according to claim 1, wherein the first conductive core part comprises a pin comprising an external thread and a jacket-like extension that comprises a corresponding internal thread for screwing the jacket-like extension to the pin, and wherein the at least one second conductive core part comprises an internal thread, and wherein a stud-like extension of the at least one second conductive core part comprises at least a stud with an external thread and a thread adapter with a corresponding internal thread for screwing the stud in the thread adapter and an external thread for screwing the thread adapter in the at least one second conductive core part, and at least one locking pin which is positioned between the jacket-like extension and the stud-like extension to provide a circumferential locking of the jacket-like extension to the at least one second conductive core part.

9. The conductor assembly according to claim 1, further comprising:

a stud-like extension as part of the at least one second conductive core part and comprising at least a stud and a locking element threaded into the stud, the stud-like extension disposed at an end of the first conductive core part, and wherein the resilient element comprises at least one preloadable spring between the first conductive core part and the at least one second conductive core part and the at least one loading arrangement comprises at least one guidance member disposed within the at least one preloadable spring, and wherein the locking element axially connects the at least one guidance member to the stud-like extension.

10. The conductor assembly according to claim 1, further comprising:

at least one sealing element arranged radially between the at least one insulating sleeve and the first conductive core part and/or the at least one second conductive core part.

11. The conductor assembly according to claim 1, wherein the at least one insulating sleeve is a one piece part, and/or wherein the at least one insulating sleeve comprises an outer surface and an inner surface, and wherein the outer surface and/or the inner surface comprises at least one conductive coating.

12. The conductor assembly according to claim 1, wherein the conductor assembly is a penetrator assembly or a connector pin assembly of a connector part of a connector unit.

13. A method for operating a conductor assembly according to claim 1, wherein the method comprises:

connecting the first conductive core part and the at least one second conductive core part in a loaded position in the axial direction by the at least one loading arrangement, wherein the first conductive core part is pulled due to a directed loading force in the axial direction against the at least one second conductive core part, clamping the at least one insulating sleeve between the first conductive core part and the at least one second conductive core part due to the loading between the first conductive core part and the at least one second conductive core part applied by the least one loading arrangement, and establishing an electrical link between the first conductive core part and the at least one second conductive core part.

14. The method of claim 13, wherein clamping the at least one insulating sleeve preloads the resilient element, wherein the resilient element connects an end of the first conductive core part and the at least one second conductive core part, wherein the clamping force of the at least one loading arrangement is applied by interaction of the first contact surface of the first conductive core part and of the second contact surface of the at least one second conductive core part with the first and the at least one second contact surfaces of the at least one insulating sleeve.

15. The method of claim 13, further comprising in an arbitrary sequence:

machining at least one insulating sleeve out of a block of solid material, finishing the at least one insulating sleeve, wherein both possible sequences result in an integrally formed pre-assembly insulating sleeve, and wherein the method further comprises:

assembling the obtained integrally formed pre-assembly insulating sleeve in the conductor assembly by clamping the integrally formed pre-assembly insulating sleeve between the first conductive core part of the conductor assembly and an at least second conductive core part of the conductor assembly due to the loading between the first conductive core part and the at least one second conductive core part applied by the at least one loading arrangement and wherein the first conductive core part is pulled due to to the directed loading force of the least one loading arrangement in the axial direction toward the at least one second conductive core part.

16. The conductor assembly according to claim 2, wherein the bushing comprises a cap.

17. The method of claim 14, further comprising:

holding a loading force of the resilient element in an assembled state of the conductor assembly so that the resilient element comprises a spring force that comprises a preload between 10% and 90%.

18. The method of claim 17, wherein the preload is about 60%.

* * * * *